US007363903B2

(12) United States Patent
Matsuda

(10) Patent No.: US 7,363,903 B2
(45) Date of Patent: Apr. 29, 2008

(54) ENGINE FOR A LEISURE VEHICLE

(75) Inventor: Yoshimoto Matsuda, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/580,516

(22) Filed: Oct. 13, 2006

(65) Prior Publication Data

US 2007/0101966 A1 May 10, 2007

(30) Foreign Application Priority Data

Oct. 17, 2005 (JP) ..... 2005-301393

(51) Int. Cl.

| | |
|---|---|
| ***F02F 7/00*** | (2006.01) |
| ***F01P 5/10*** | (2006.01) |
| ***F01M 1/02*** | (2006.01) |
| ***F02B 67/00*** | (2006.01) |

(52) U.S. Cl. ..... 123/195 R; 123/41.44; 123/196 R; 123/198 C

(58) Field of Classification Search ..... 123/198 C, 123/41.44, 41.52, 41.72, 41.74, 41.79, 196 AB, 123/196 S, 196 R, 195 R
See application file for complete search history.

(56) References Cited

U.S. PATENT DOCUMENTS

| | | | | |
|---|---|---|---|---|
| 5,024,189 | A * | 6/1991 | Ushio et al. | 123/195 R |
| 5,095,871 | A * | 3/1992 | Mezger | 123/198 C |
| 5,456,227 | A * | 10/1995 | Shimmell et al. | 123/195 H |
| 6,305,332 | B1 * | 10/2001 | Nishi et al. | 123/41.29 |
| 6,308,680 | B1 * | 10/2001 | Prior | 123/195 R |
| 6,647,944 | B2 * | 11/2003 | Kamiya | 123/195 R |
| 6,684,845 | B2 * | 2/2004 | Cho | 123/195 H |
| 6,990,943 | B2 * | 1/2006 | Koyama | 123/193.2 |
| 7,063,063 | B2 * | 6/2006 | Morii et al. | 123/198 R |
| 2004/0247444 | A1 * | 12/2004 | Oshita et al. | 416/244 R |
| 2006/0005791 | A1 * | 1/2006 | Obidi | 123/41.29 |

FOREIGN PATENT DOCUMENTS

JP 2004-330990 11/2004

* cited by examiner

*Primary Examiner*—Stephen K. Cronin
*Assistant Examiner*—Ka Chun Leung
(74) *Attorney, Agent, or Firm*—Alleman Hall McCoy Russell & Tuttle LLP

(57) ABSTRACT

An engine for a leisure vehicle including a crankcase having at least two crankcase portions, a plurality of main journal fastener bolts by which the two crankcase portions are coupled to each other such that a crankshaft is rotatably mounted between the two crankcase portions, an oil pump disposed below the plurality of main journal fastener bolts and a vicinity of the main journal fastener bolts, and a water pump disposed laterally of the oil pump in such a manner that a rotational shaft of the water pump is coaxial with a rotational shaft of the oil pump.

8 Claims, 4 Drawing Sheets

ENGINE FOR A LEISURE VEHICLE

TECHNICAL FIELD

The present invention generally relates to engines mounted in leisure vehicles such as motorcycles, and more particularly to a liquid-cooled four-cycle engine suitable for use with motorcycles.

BACKGROUND ART

Four-cycle engines mounted in leisure vehicles such as motorcycles are required not only to exhibit high performance but also to have excellent external design appearance. In a water-cooled four-cycle engine, a water pump is disposed outside a crankcase to be apart from a cylinder block of the engine. An inlet port of the water pump is coupled to an outlet port of a radiator disposed behind a front wheel of the motorcycle through a rubber hose, and an outlet port of the water pump is coupled to an inlet port of a cooling water passage formed in the cylinder block of the engine through a rubber hose (see Japanese Laid-Open Patent Application Publication No. 2004-330990).

The rubber hose exposed outside may degrade external appearance of a motorcycle which is not equipped with a cowling, because the rubber is typically black and is noticeable. In addition, the rubber hose tends to wear out due to contact with other parts of the motorcycle during vibration of the engine.

SUMMARY OF THE INVENTION

The present invention addresses the above described conditions, and an object of the present invention is to provide an engine for a leisure vehicle which has a simple external appearance and is provided with a relatively short cooling water passage to be suitable for use with the motorcycle.

According to the present invention, there is provided an engine for a leisure vehicle comprising a crankcase including at least two crankcase portions; a plurality of main journal fastener bolts by which the two crankcase portions are coupled to each other such that a crankshaft is rotatably mounted between the two crankcase portions; an oil pump disposed below the plurality of main journal fastener bolts and a vicinity of the main journal fastener bolts; and a water pump disposed laterally of the oil pump in such a manner that a rotational shaft of the water pump is coaxial with a rotational shaft of the oil pump.

In accordance with the leisure vehicle constructed above, since the oil pump is disposed below the main journal fastener bolts and its vicinity, the water pump, which is disposed such that its rotational shaft is coaxial with the rotational shaft of the oil pump, can be externally mounted to a side wall of the crankcase of the engine to form a unitary appearance together with the engine block, and the outlet port of the water pump can be directly coupled to the inlet port of the cooling water passage formed in the side wall of the crankcase without the rubber hose. Therefore, the engine can be configured to have a simple construction in external appearance, and the cooling water can be smoothly supplied to a cylinder or a cylinder head with a short cooling water passage.

Preferably, the oil pump may be separable from the crankcase. The engine can be easily overhauled because even if the oil pump is positioned under the main journal fastener bolts, the oil pump can be easily removed from the crankcase, and the main journal fastener bolts are accessible from below the crankcase.

Preferably, the water pump may be separable from the crankcase. During overhaul of the engine or inspection of the water pump, the water pump can be easily removed from the crankcase.

Preferably, an outlet port of the water pump may be directly coupled to an inlet port of a cooling water passage (water jacket) formed in a side wall of the crankcase.

Preferably, the cooling water passage may extend upward through a front wall of the crankcase. Thereby, the cooling water can be easily supplied from the outlet port of the water pump to the cylinder located thereabove.

Preferably, the cooling water passage may extend upward through a rear wall of the crankcase. Thereby, cooling water with a low temperature can be supplied to a rear region of the cylinder which is not exposed to air flowing forward.

The above and further objects and features of the invention will more fully be apparent from the following detailed description with accompanying drawings.

DETAILED DESCRIPTION OF THE PREFERRED EMBODIMENTS

Figure 1:
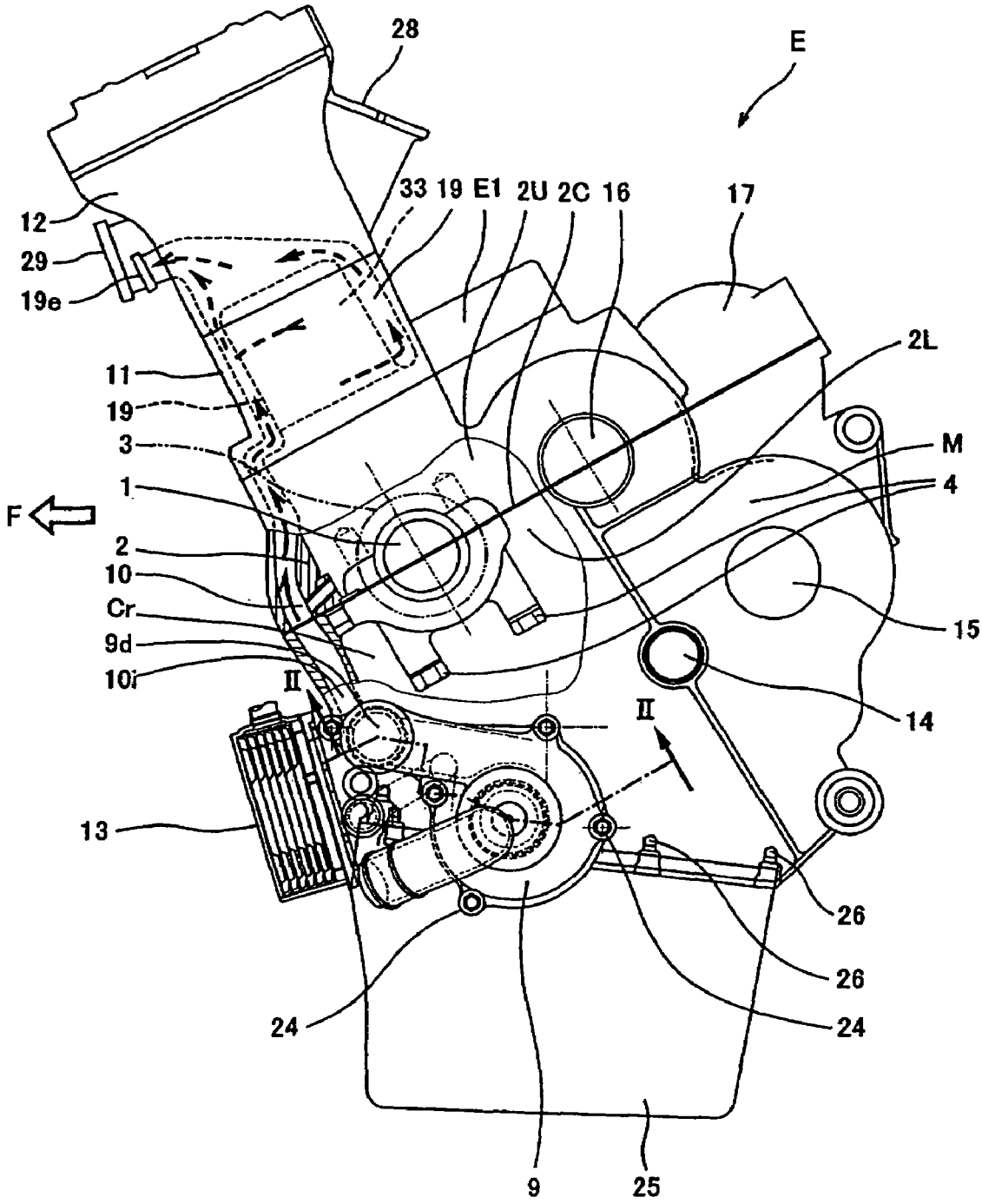
FIG. 1 is a side view schematically showing an engine for a leisure vehicle according to an embodiment of the present invention.
Figure 2:
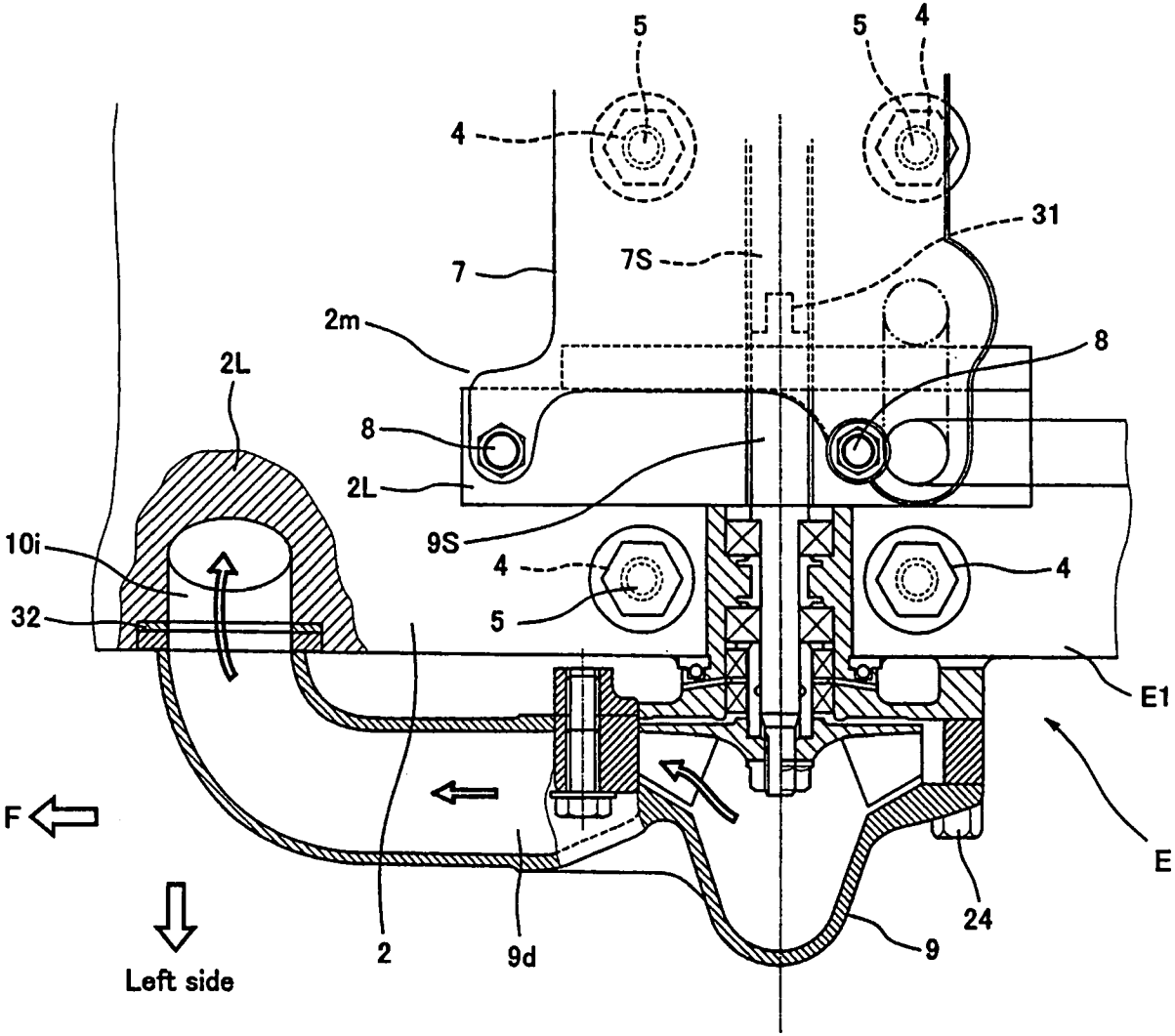
FIG. 2 is an enlarged view taken in the direction of arrows along line II-II of FIG. 1, showing arrangement of an oil pump and a water pump of the engine of FIG. 1.
Figure 3:
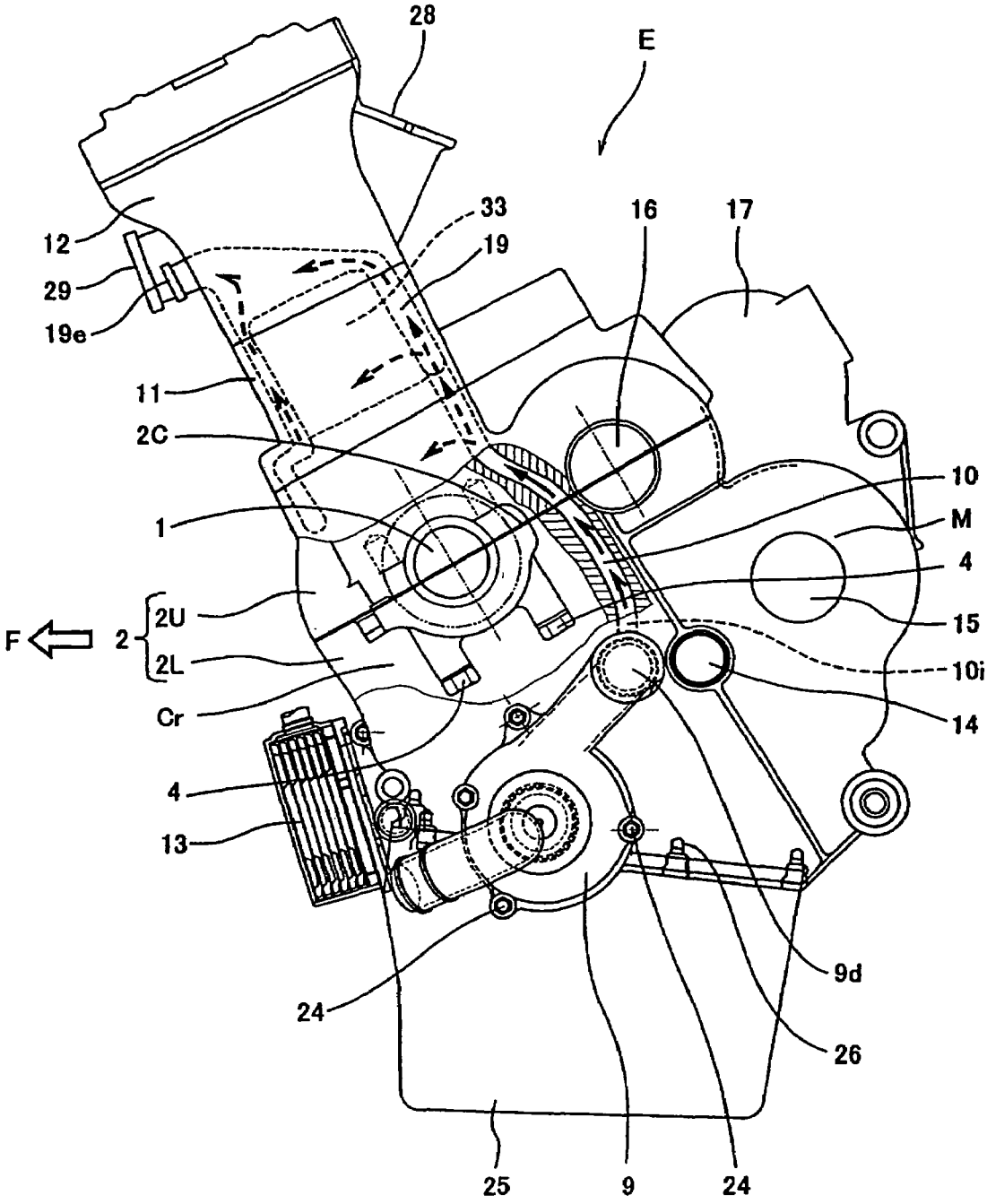
FIG. 3 is a side view showing a construction of an engine according to another embodiment.

Now, an engine for a leisure vehicle according to embodiments of the present invention will be described with reference to the drawings. Hereinbelow, a water-cooled four-cycle engine for a motorcycle, which is one type of the leisure vehicle, will be described. In FIGS. 1 to 3, an arrow F indicates forward of the motorcycle.

A four-cycle engine E of this embodiment has multiple cylinders, for example, four cylinders. As shown in FIG. 1, a crankshaft 1 of the engine E is rotatably mounted to a crankcase 2 by a main journal bearing 3 at a parting plane 2C of the crankcase 2 composed of an upper crankcase 2U and a lower crankcase 2L. Whereas the crankcase 2 is shown to be integral with casings of a transmission M, a generator 17, and a balancer 16 which are located behind the crankcase 2, it will be appreciated that the crankcase 2 may be separable from these casings.

The main journal bearing 3 by which the crankshaft 1 is rotatably mounted is retained at bearing housing portions formed by the upper crankcase 2U and the lower crankcase 2L of the crankcase 2. The upper crankcase 2U and the lower crankcase 2L are coupled to each other by pairs of front and rear main journal fastener bolts 4 to form the journal housing portions of the crankcase 2 therebetween.

The pair of main journal fastener bolts 4 are mounted for each of bearing housing portions to be located on both sides of the crankshaft 1 retained at the bearing housing by the main journal bearing 3. That is, as shown in FIG. 2, two main journal fastener bolts 4 are provided for each main journal bearing 3 (see FIG. 1). In the four-cylinder engine of this embodiment, the crankshaft 1 is rotatably mounted to the crankcase 2 via five main journal bearings 3 by ten journal fastener bolts 4. In FIG. 2, two pairs of main journal fastener bolts 4 and the corresponding mounting holes 5 are illustrated at a left end portion (lower end portion of FIG. 2) of the engine E.

As shown in FIG. 2, an oil pump 7 is disposed below mounting regions of the main journal fastener bolts 4 (see FIG. 1) and is mounted separably from the crankcase 2. In the engine E which is a dry sump engine as illustrated in this embodiment, the oil pump 7 is removably mounted to a bottom wall 2*m* (see FIG. 2) of a crank chamber Cr accommodating the crankshaft and located thereabove by a plurality of mounting bolts 8. In a wet sump engine which is not provided with the bottom wall 2*m*, the oil pump 7 is removably mounted by bolts to the bearing housing portion containing the main journal bearing 3 or a bracket (not shown) extending therefrom. Irrespective of whether the engine E is a dry sump engine or a wet sump engine, the oil pump 7 is removable from the engine block E1, to be specific, from the crankcase 2 (to be precise from the lower crankcase 2L), by removing the plurality of mounting bolts 8.

In the dry sump engine, the oil pump 7 is surrounded by the bottom wall 2*m* of the crank chamber Cr from above and with the oil pan 25 (see FIG. 1) from laterally and below. The oil pan 25 is attached to a lower end of the lower crankcase 2L by a plurality of mounting bolts 26 (see FIG. 1). Before removing the oil pump 7, it is necessary to remove mounting bolts 26 by which the oil pan 25 is mounted to the lower crankcase 2L to remove the oil pan 25 from the crankcase 25. The oil pump 7 and a water pump 9 described later are separable from the crankcase 2. This means that the oil pump 7 and the water pump 9 function as a pump in a single unit state which is removed from the crankcase 2, and a part of the crankcase 2 is not used to form separating walls of the oil pump 7 and the water pump 9 or a part of pump casings, etc.

As shown in FIG. 2, the water pump 9 is disposed in such a manner that a rotational shaft 9S thereof is coaxial with a rotational shaft 7S of the oil pump 7. The water pump 9 is externally mounted by a plurality of mounting bolts 24 to a left side wall of the lower crankcase 2L in such a manner that the water pump 9 is disposed laterally of the oil pump 7 and on a left side portion of the engine E (in this case, outside of the left side wall of the lower crankcase 2L). As in the oil pump 7, the water pump 9 is separable from the crankcase 2. By removing the plurality of mounting bolts 24, the water pump 9 is removed from the crankcase 2. The water pump 9 is also separable from the oil pump 7. The rotational shaft 9S of the water pump 9 and the rotational shaft 7S of the oil pump 7 engage with each other by a concave-convex engagement structure (mesh structure) 31 and is configured to be integrally rotatable. The water pump 9 is separated from the oil pump 7 by axially extracting the rotational shaft 9S of the water pump 9 from the rotational shaft 7S of the oil pump 8.

As shown in FIG. 2, the water pump 9 is disposed laterally of and adjacent the left side wall of the crankcase 2 in such a manner that the water pump 9 and the crankcase 2 have a unitary external appearance. An outlet port 9*d* of the water pump 9 is coupled in a sealed state by a packing 32 to an inlet port 10*i* of a cooling water passage 10 formed in the crankcase 2.

Figure 4:
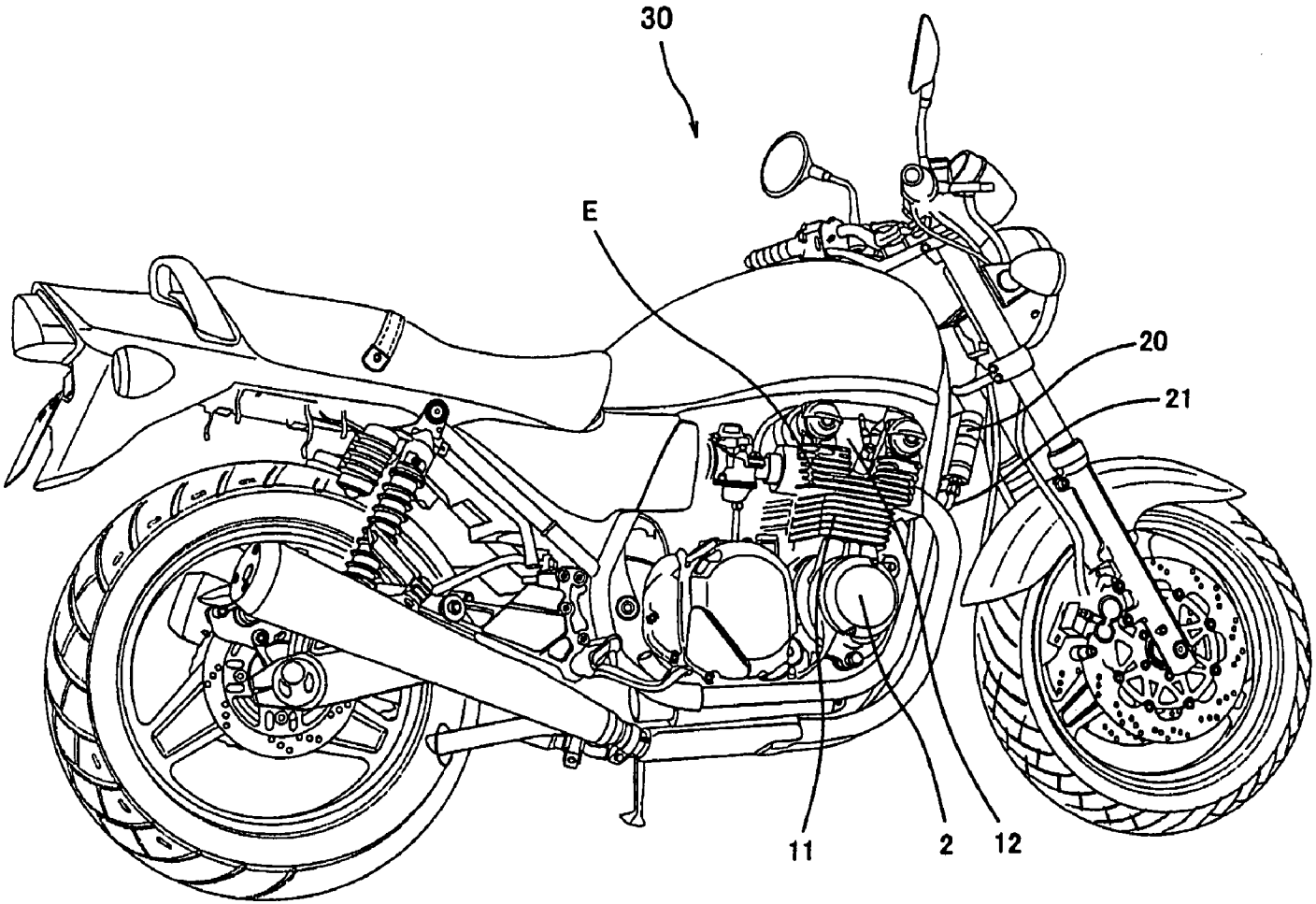
FIG. 4 is a side view of the motorcycle in which the engine of FIG. 1 or 3 is mounted.

As shown in FIG. 1, the cooling water passage 10 extends upward through a front wall of the crankcase 2 and is connected to a cooling water passage (water jacket) 19 formed in the cylinder 11 and the cylinder head 12 to cool the cylinder 11 and the cylinder head 12. An outlet port 19*e* of the cooling water passage 19 is located at an upper region of the cylinder head 12 of the engine E. As shown in FIG. 4, the outlet port 19*e* of the cooling water passage 19 is coupled to the inlet port of the radiator 20 located forward of the engine E through a rubber hose 21.

As shown in FIG. 1, an oil cooler 13 is disposed forward of and adjacent the engine E and is configured to cool oil fed with a pressure from the oil pump 7 (see FIG. 2). The transmission M is disposed at a rear portion of the engine E. The transmission M includes an input shaft 14 that transmits a rotational speed from the crankshaft 1 toward the transmission M, a gear train (not shown) which changes the rotational speed transmitted from the input shaft 14 to an output shaft 15, and the output shaft 15 which outputs the resulting rotational speed. The engine E is provided with the balancer 16 for reducing vibration, and with the generator 17. A mounting portion 28 is formed at a rear portion of the cylinder head 12 of the engine E to mount a throttle body (not shown) of an air-intake device of the engine E. An exhaust pipe connecting portion 29 is formed at a front portion of the cylinder head 12 to couple an exhaust pipe (not shown) forming an exhaust passage of the engine E.

In this embodiment, as shown in FIG. 1, the parting plane 2C of the crankcase 2 extends along a line connecting rotational axes of the crankshaft 1, the balancer 16, and the generator 17, although the rotational axis of the generator 17 is not illustrated. The rotational speed is transmitted from the crankshaft 1 to the input shaft 14 through a gear train (not shown). The rotational speed is also transmitted from the crankshaft 1 to the rotational shaft 7S of the oil pump 7 (FIG. 2) through a gear train (not shown).

The above constructed water-cooled four-cycle engine E of the motorcycle 30 achieves advantages as follows. As shown in FIG. 2, the outlet port 9*d* of the water pump 9 is directly coupled to the inlet port 10*i* of the cooling water passage 10 formed in the crankcase 2 without the rubber hose. In this construction, the cooling water is supplied from the water pump 9 to the cooling water passage 19 of the engine E through the cooling water passage 10 formed in the crankcase 2. The external appearance of the motorcycle 20 equipped with the engine E is improved as shown in FIG. 4, because of absence of the black rubber hose exposed outside.

Since a cooling water passage of the water pump 9 and the cooling water passages 10 and 19 are formed of stiff passages, and therefore are not deformed due to a pressure fluctuation of the cooling water flowing therein, the cooling water can be supplied therethrough with less pressure loss. The water pump 9 and the oil pump 7 can be easily removed from the engine block E1 for the purpose of inspection and repair.

In the embodiment described above, the cooling water passage 10 is formed to be located forward of the water pump 9, i.e., in the front wall of the crankcase 2 (crank chamber). Alternatively, as shown in FIG. 3, the outlet port 9*d* of the water pump 9 may be located at a rear wall of the crankcase 2 (crank chamber) behind the water pump 9 (transmission M side), and is coupled to inlet port 10*i* of the cooling water passage 10 formed in the rear wall of the crankcase 2 so that the cooling water is supplied to the cooling water passage 19 of the engine E through the cooling water passage 10 formed in the rear wall of the crankcase 2. In such a construction, since the cooling water with a low temperature can be first supplied to a rear region of the engine block E1 which is not relatively exposed to cooling wind flowing forward, a temperature distribution is desirably made uniform at the front portion and the rear portion of the engine E. In FIG. 3, the same reference numbers as those of FIG. 1 denote the same or corresponding parts, which will not be further described.

In the embodiment described above, the oil pump 7 and the water pump 9 are formed separately from each other, however, it will be appreciated that they may alternatively be formed integrally with each other.

The oil pump 7 is disposed outside of the crank chamber Cr in the dry sump engine E as illustrated in the above embodiments and is disposed in the interior of the crank chamber Cr in the wet sump engine.

The engine E of the present invention is applicable to leisure vehicles other than motorcycles, in which the engine is exposed outside.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An engine for a leisure vehicle comprising:

a crankcase including at least two crankcase portions;

a plurality of main journal fastener bolts by which the two crankcase portions are coupled to each other such that a crankshaft is rotatably mounted between the two crankcase portions;

an oil pump mounted to the crankcase from below by fastener bolts extending substantially upward, wherein the oil pump is disposed below the plurality of main journal fastener bolts and in a vicinity of the main journal fastener bolts, and wherein the oil pump is removably mounted to the crankcase; and a water pump disposed laterally of the oil pump in such a manner that a rotational shaft of the water pump is coaxial with a rotational shaft of the oil pump.

2. The engine for a leisure vehicle according to claim 1, wherein the water pump is removably mounted to the crankcase.

3. The engine for a leisure vehicle according to claim 2, wherein an outlet port of the water pump is directly coupled to an inlet port of a cooling water passage formed in a region of a side wall of the crankcase, wherein the inlet port of the cooling water passage is disposed below an axis of the crankshaft and is formed inside the region of the side wall of the crankcase that extends in a direction perpendicular to the axis of the crankshaft, and wherein the cooling water passage extends upward and so as to cross a parting plane formed by the two crankcase portions and is formed inside the region of the side wall of the crankcase, and an outlet port of the cooling water passage is connected to a lower end portion of a water jacket formed in a wall of a cylinder.

4. The engine for a leisure vehicle according to claim 3, wherein the region of the side wall of the crankcase in which the cooling water passage is formed to extend upward is a front wall of the crankcase and the cooling water passage extends upward through the front wall of the crankcase with the engine mounted in a vehicle body of a motorcycle.

5. The engine for a leisure vehicle according to claim 3, wherein the region of the side wall of the crankcase in which the cooling water passage is formed to extend upward is a rear wall of the crankcase and the cooling water passage extends upward through the rear wall of the crankcase with the engine mounted in a vehicle body of the motorcycle.

6. An engine for a leisure vehicle comprising:

a crankcase including at least two crankcase portions, the at least two crankcase portions including an upper crankcase portion above which a cylinder is disposed and a lower crankcase portions below which an oil pan is mounted;

a plurality of main journal fastener bolts by which the two crankcase portions are coupled to each other such that a crankshaft is rotatably mounted between the two crankcase portions;

an oil pump disposed below the plurality of main journal fastener bolts and a vicinity of the main journal fastener bolts; and a water pump disposed laterally of the oil pump in such a manner that a rotational shaft of the water pump is coaxial with a rotational shaft of the oil pump, wherein an outlet port of the water pump is directly coupled to an inlet port of a cooling water passage formed in a region of a side wall of the crankcase, wherein the inlet port of the cooling water passage is disposed below an axis of the crankshaft and is formed inside the region of the side wall of the crankcase that extends in a direction perpendicular to the axis of the crankshaft, and wherein the cooling water passage extends upward and so as to cross a parting plane formed by the two crankcase portions and is formed inside the region of the side wall of the crankcase, and an outlet port of the cooling water passage is connected to a lower end portion of a water jacket formed in a wall of a cylinder.

7. The engine for a leisure vehicle according to claim 6, wherein the region of the side wall of the crankcase in which the cooling water passage is formed to extend upward is a front wall of the crankcase and the cooling water passage extends upward through the front wall of the crankcase with the engine mounted in a vehicle body of a motorcycle.

8. The engine for a leisure vehicle according to claim 6, wherein the region of the side wall of the crankcase in which the cooling water passage is formed to extend upward is a rear wall of the crankcase and the cooling water passage extends upward through the rear wall of the crankcase with the engine mounted in a vehicle body of the motorcycle.

* * * * *